United States Patent [19]

Larson

[11] Patent Number: 4,465,279

[45] Date of Patent: Aug. 14, 1984

[54] REGULAR DODECAHEDRON DIE WITH OPPOSITE FACES HAVING IDENTICAL NUMBERS OF INDICIA

[76] Inventor: Roland E. Larson, 122 W. 35th St., Erie, Pa. 16508

[21] Appl. No.: 343,585

[22] Filed: Jan. 28, 1982

Related U.S. Application Data

[63] Continuation-in-part of Ser. No. 930,417, Aug. 2, 1978, abandoned.

[51] Int. Cl.[3] ..... A63F 9/04

[52] U.S. Cl. ..... 273/146

[58] Field of Search ..... 273/146; 434/208; D21/41

[56] References Cited

U.S. PATENT DOCUMENTS

| | | | |
|---|---|---|---|
| 1,279,409 | 9/1918 | Murray | 273/146 |
| 1,480,360 | 1/1924 | Agee, Jr. | 273/146 M X |
| 1,523,615 | 1/1925 | Stern | 273/146 |
| 1,539,015 | 5/1925 | Mitchell | 273/146 |
| 2,227,406 | 12/1940 | Christy | 273/146 |
| 3,399,897 | 9/1968 | Mitchell | 273/146 |
| 3,904,208 | 9/1975 | Grossman | 273/146 |

FOREIGN PATENT DOCUMENTS

| | | | |
|---|---|---|---|
| 621488 | 2/1927 | France | 273/146 |
| 1320101 | 1/1963 | France | 273/146 |

*Primary Examiner*—Robert A. Hafer
*Assistant Examiner*—Arnold W. Kramer
*Attorney, Agent, or Firm*—Charles L. Lovercheck; Wayne L. Lovercheck; Dale R. Lovercheck

[57] ABSTRACT

A playing device, in particular, a die having a body shape as a regular dodecahedron having twelve faces and a plurality of countable indicia one to six. Each total from one to six appears on precisely two opposite faces. Moreover, the two faces containing a given total lie on parallel opposing faces so that each opposite face is provided with the same number of recesses and therefore the die will be evenly balanced at all parts from its center. Each indicia is conical in shape and is recessed in the body adjacent to the dodecahedron faces. The faces of the die are pentagonal in shape and the placement of the indicia are such that the indicia on each planar face is identical to the number of indicia on the opposite planar face parallel to the first mentioned planar face. Thereby providing a perfect balanced die with its center of mass coincides with its geometrical center whereby greater random playing results are achieved and less chance for trickery.

1 Claim, 14 Drawing Figures

REGULAR DODECAHEDRON DIE WITH OPPOSITE FACES HAVING IDENTICAL NUMBERS OF INDICIA

This application is a continuation in part of patent application Ser. No. 930,417, filed Aug. 2, 1978, now abandoned.

REFERENCE TO PRIOR ART

The die, according to the present invention, constitutes an improvement over the dies shown in U.S. Pat. No. 1,279,409, which shows a six-sided, evenly-balanced die wherein seven recesses on each side are provided. The recesses that count are painted white. Thus half the recesses are useless and require time and expense to manufacture and could cause confusion to the user.

U.S. Pat. No. 3,399,897 is an eight sided die with spots 1–8 on the sides. Balance is achieved by removing material from the die to provide a balanced body by means of the removed material being in the form of a total of eighteen dimples about each axis passing through a corner with the number of dimples on each face being of a different amount.

U.S. Pat. No. 1,523,615 shows a 12 sided die with spots printed on. The spots on opposite sides total 7. These spots will wear off with handling. If these spots were recessed, the die would be unbalanced.

French Pat. No. 621,488 shows a 12 sided die with numerals on its side. The sides are painted different colors to conform to compartments in a betting board, which is a different type of device from Applicant's. This patent has neither recesses nor spots.

OBJECTS OF THE INVENTION

It is an object of the invention to provide an improved playing die.

Another object is to provide a die having twelve sides with equal numbers of recesses on each two parallel sides and having its center of mass at its geometrical center.

Another object of the invention is to provide a playing die that is equally balanced, simple in construction and economical to manufacture and simple and efficient to use.

With the above and other objects in view, the present invention consists of the combination and arrangement of parts hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

Figure 1:
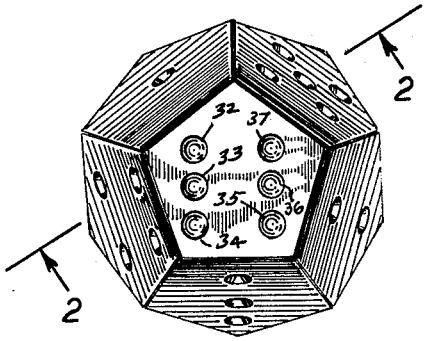
FIG. 1 is a side view of a die according to the invention.

FIG. 3*a* is a view of one face of the die.

FIG. 3*b* is a view of another face of the die.

FIG. 3*c* is a view of yet another face of the die.

FIG. 3*d* is a view of yet another face of the die.

FIG. 3*e* is a view of yet another face of the die.

FIG. 3*f* is a view of still another face of the die.

FIG. 4*a* is a view of another embodiment of the invention similar to the face of the die shown in FIG. 3*a*.

FIG. 4*b* is a view of a face of the die corresponding to the face shown in FIG. 3*b* of another embodiment of the invention.

FIG. 4*c* is a view similar to FIG. 3*c* of another embodiment of the invention.

FIG. 4*d* is a view similar to FIG. 3*d* of another embodiment of the invention.

FIG. 4*e* is a view similar to FIG. 3*e* of another embodiment of the invention.

FIG. 4*f* is a view similar to FIG. 3*f* of another embodiment of the invention.

GENERAL DESCRIPTION OF THE INVENTION

In the invention disclosed herein, for each of the sides having a number of recesses one through six thereon, each opposite side has the same number of recesses that form the indicia.

Aside from their pleasing shape, there is an advantage to the die disclosed herein over the standard cubical die. The invention stems from the fact that each of the indicia is recessed in the die and indicia on opposite sides and the number of indicia on each two opposite sides are equal so that the center of mass of the die coincides with the geometrical center of the die. The result is that the probability of each total is truly one sixth. On a standard cubical die, the recessing of the indicia on the square face results in the center of mass of each die being closer to the corner of the faces bearing the totals one, two and three, than to the corners of the faces bearing the totals four, five and six. I have tested the probability of each of the six totals for a standard cubical die. Out of 27,000 random tosses, the totals of one through six appeared 4293, 4524, 4492, 4397, 4623, and 4761 times, respectively. This result is statistically significant to prove that the probability of each total on a standard cubical die with recessed indicia is not one sixth as commonly supposed. For example, at the 95% confidence level, the probability of a total of one on a standard cubical die with recessed indicia turned out to be 0.159 plus or minus 0.004 (somewhere between 0.155 and 0.163). At the 95% confidence level, the probability of a total of six on a standard cubical die with recessed indicia turned out to be 0.173 plus or minus 0.004 (somewhere between 0.169 and 0.177). At the 95% confidence level, the probability of one-sixth (0.167) is, therefore, excluded for totals of one and six. Furthermore, on a standard cubical die with recessed indicia, the total of six is actually more likely than a total of one.

The models of the die preferred are white with black indicia. However, since each total on my die appears twice, it will be possible to have two different color schemes on each die. For example, the die could be constructed so that half of the faces would be black with white indicia and half would be white with black indicia. The models constructed are 13/16" in height. The height could vary between ¾ inch and 1 inch. If the height were smaller than ¾ inch, the indicia on each side would become difficult to see. If the height were greater than 1 inch, it would become awkward for a player to toss a pair of the dice with one hand. The preferred models have the indicia placed in roughly the same patterns for each total as used on the standard cubical dice. After testing various patterns with different players, it has been discovered that they could most easily recognize the standard configuration of indicia. However, an option of the standard placement could be according to FIGS. 4*a*–4*f* disclosed herein. The advantages of this option is that it is more pleasing to the eye in relation to the pentagonal shaped faces of the die.

DETAILED DESCRIPTION OF THE DRAWINGS

Now, with more particular reference to the drawings, the dice shown are in the form of a regular dodecahedron having twelve flat equally sized faces, each face being disposed in a plane parallel to the plane of the face opposite and each face having the shape of a pentagon. The die is indicated generally at 10 having five-sided faces 11, 12, 13, 14, 15, and 16.

Face 11 has a single recess 17 in its center, face 12 has two recesses 18 and 19 formed in its surface, face 13 has three recesses 20, 21 and 22 formed in it, face 14 has four recesses 23, 24, 25 and 26 formed in it, face 15 has five recesses 27, 28, 29, 30 and 31 in it, and face 16 has six recesses 32, 33, 34, 35, 35, and 37 formed in it.

Figure 4:
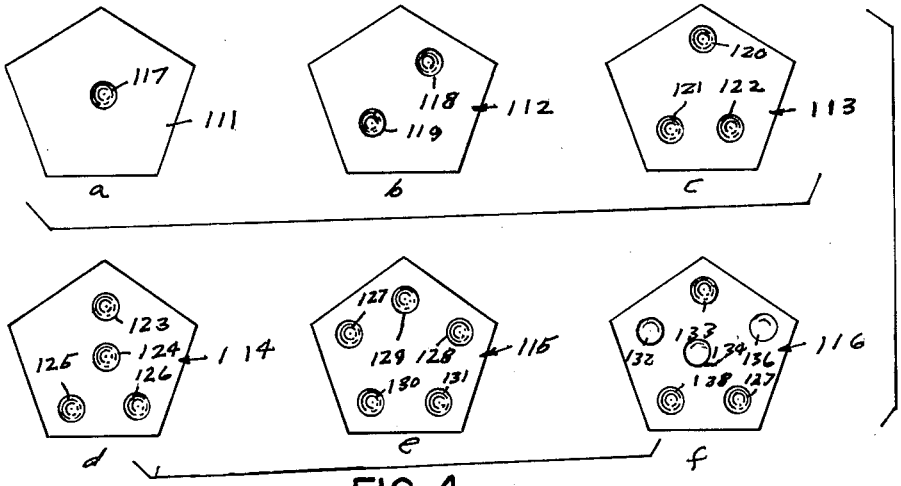

In the embodiment of the invention shown in FIG. 4, the face 111 has one recess 117, the face 112 has two recesses 118 and 119, face 113 has three recesses 120, 121 and 122, the face 114 has four recesses 123, 124, 125 and 126, face 115 has five recesses 127, 128, 129, 130 and 131, and the face 116 has six recesses 132, 133, 134, 136, 137 and 138.

It will be seen that the recesses are conical in cross section and the indicia remove a substantial amount of the mass of the particular side on which they are recessed.

Since one side having six recesses is opposite the other side having six recesses and one side having one recess is opposite the other side having one recess, etc., the die will not be unbalanced because of the symmetrical location of the sides having an equal number of recesses.

In the embodiment of the invention shown in FIG. 4, the recess 117 in the side 111 is symmetrically located relative to the sides. The two recesses 118 and 119 in the side 112 are located differently relative to the edges of the die and the recesses 120, 121 and 122 in the side 113 are not aligned as shown in the side 13. Likewise, in the sides 114, 115 and 116, the recesses are arranged differently than in the corresponding sides in the embodiment of FIG. 3.

Figure 3:
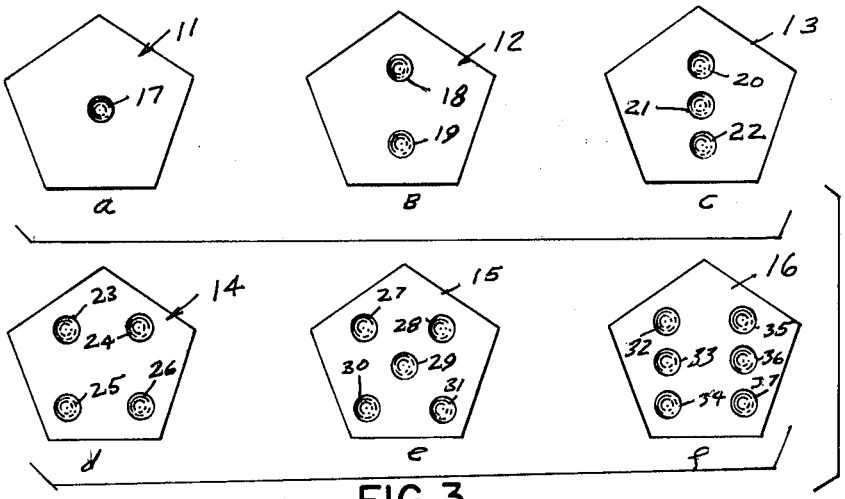

In each of the embodiments shown in FIG. 1, 3 and 4, a side parallel to the plane of any particular side and on the opposite side of the dice will have the same number of recesses as the particular side.

Figure 2:
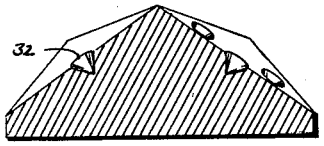
FIG. 2 is a partial cross-sectional view taken on Line 2—2 of FIG. 1.

An alternate arrangement of indicia is shown in FIG. 4 which are more pleasing to the eye than the familiar arrangement of FIGS. 1–3.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property of privilege is claimed are defined as follows:

1. A die having a regular dodecahedron shape with twelve flat faces, each two said faces opposite each other having identical numbers of recesses formed therein different from any other of said faces, said recesses being formed by deleting material thereby reducing the weight of each side of said die, said recesses being from one to six, all of said recesses being of equal size and shape, said recesses making up the indicia on each two opposite sides being equal in number whereby the center of mass of the die coincides with the geometrical center of the die resulting in a probability that is truely one sixth, and the center of mass of the die is half way between any two parallel sides of the die, said recesses on the respective sides of said die are arranged in generally the same relation to the patterns on the conventional cube shaped die.

* * * * *